US011712112B2

(12) United States Patent
Wang et al.

(10) Patent No.: US 11,712,112 B2
(45) Date of Patent: Aug. 1, 2023

(54) SLIDING TYPE CHILDREN'S DRAWER LOCK

(71) Applicant: NINGBO FABE CHILD SAFETY CO., LTD., Ningbo (CN)

(72) Inventors: Xinjun Wang, Jinan (CN); Li Dong, Jinan (CN)

(73) Assignee: NINGBO FABE CHILD SAFETY CO., LTD., Ingbo (CN)

( * ) Notice: Subject to any disclaimer, the term of this patent is extended or adjusted under 35 U.S.C. 154(b) by 0 days.

(21) Appl. No.: 17/667,455

(22) Filed: Feb. 8, 2022

(65) Prior Publication Data

US 2022/0400859 A1 Dec. 22, 2022

(30) Foreign Application Priority Data

Jun. 21, 2021 (CN) ..... 202110687549.2

(51) Int. Cl.
*A47B 88/50* (2017.01)

(52) U.S. Cl.
CPC ..... *A47B 88/50* (2017.01)

(58) Field of Classification Search
CPC ..... A47B 88/50; A47B 88/53
See application file for complete search history.

(56) References Cited

U.S. PATENT DOCUMENTS 4,139,249 A * 2/1979 Hillman ..... E05B 65/0014 292/87
4,717,184 A * 1/1988 Boyce ..... E05B 65/0014 292/87
5,344,226 A * 9/1994 Lee ..... E05B 65/46 312/334.47
5,445,451 A * 8/1995 Harmony ..... A47B 88/57 312/333
5,645,304 A * 7/1997 Richardson ..... E05B 65/0014 292/19
6,481,811 B1 * 11/2002 Marsh ..... A47B 88/57 292/87
6,942,257 B2 * 9/2005 Wong ..... E05B 65/0014 292/228
6,955,380 B1 * 10/2005 Barr ..... E05C 19/06 292/84
7,261,329 B1 * 8/2007 Julian ..... E05B 65/0014 292/87
8,056,989 B2 * 11/2011 Zielinski ..... E05B 65/46 292/84

(Continued)

*Primary Examiner* — Daniel J Rohrhoff
(74) *Attorney, Agent, or Firm* — Global IP Services; Tianhua Gu

(57) ABSTRACT

A sliding type children's drawer lock comprises a lock match arranged on the inner side of the drawer cabinet and located at the opening of the drawer cabinet, and a lock body that is arranged on the inner end surface of the drawer and can cooperatively lock with the lock catch. The lock body comprises a base arranged on the inner end surface of the drawer, a connecting block is arranged in the base, a lock hook matched with the latch is arranged at the end of the connecting block, an inserting plate is located in a chamber and inserted into a jack, a spring is arranged in the chamber, and the connecting block is driven to slide in a chute through a pick. After locking the latch cooperate to lock, the maximum length that the drawer opens is just enough to expose one end of the pick away from slots.

15 Claims, 6 Drawing Sheets

(56) References Cited

U.S. PATENT DOCUMENTS

| | | | | |
|---|---|---|---|---|
| 9,593,509 | B2 * | 3/2017 | Murray | E05B 65/0014 |
| 11,377,878 | B1 * | 7/2022 | Cheung | A47B 88/50 |
| 2019/0323267 | A1 * | 10/2019 | Hertrich | E05C 19/188 |

* cited by examiner

SLIDING TYPE CHILDREN'S DRAWER LOCK

TECHNICAL FIELD

The invention relates to the field of drawer locks, particularly a sliding type children's drawer lock.

BACKGROUND ART

As growing up, babies become more and more curious about the world. In life, they often rummage. In order to prevent babies from opening cabinet doors and drawers, turning over objects, eating and misuse dangerous drugs and knives, parents often use drawer locks for protection.

At present, most drawer locks on the market use keys to open metal locks, which is very inconvenient for key management and use. The commonly used special children's locks need to open the drawer for a certain distance to expose the internal gap of the drawer, and then the adult fingers extend into the drawer and press the switch of the drawer lock to unlock. However, the open gap distance is still large. Curious babies are easy to see the objects inside the drawer, and even reach small dangerous objects, which makes the drawer lock protection lose the effect. In addition, with the open space of the drawer, the babies can reach into their hands, which is easy to cause pinch injury.

SUMMARY OF THE INVENTION

The invention aims to provide a sliding type children's drawer lock, which adopts a pick sliding unlocking device and unlocks without exposing the drawer gap, making the unlocking more concealed, and preventing children from extending their fingers into the drawer gap, so as to greatly improve the safety, effectiveness and appearance.

A sliding type children's drawer lock comprises a lock catch arranged on the inner side of the drawer cabinet and located at the opening of the drawer cabinet, and a lock body that is arranged on the inner end surface of the drawer and can cooperatively lock with the lock catch;

The lock body comprises a base arranged on the inner end surface of the drawer, a chute is opened on the side of the base away from the inner end surface of the drawer, a connecting block is slidably arranged in the chute, a lock hook which is locked and matched with the lock catch is arranged at the end of the connecting block away from the base, a chamber is arranged in the connecting block, a jack communicating with the chamber is arranged at the end of the connecting block away from the lock catch; an inserting plate is arranged on the base, the inserting plate is located in the chamber and inserted into the jack; a spring is arranged in the chamber, one end of the spring is against the inner wall of the chamber and the other end of the spring is against the end surface of the inserting plate, the side of the connecting block close to the top opening of the drawer is provided with slots, a pick is inserted in the slots, and the pick drives the connecting block to slide in the chute;

The installation of the lock catch and lock body on a designated position ensures that after the lock hook and the lock catch cooperate to lock, the maximum length that the drawer opens is just enough to expose one end of the pick away from the slots.

The end of the inserting plate away from the base and away from the lock catch is provided with a clamping groove, the end of the connecting block away from the lock hook and away from the base is rotatably provided with an L-shaped locking valve, one end of the lock valve penetrates the outer wall of the connecting block, and the other end of the lock valve is located in the connecting block and is clamped with the clamping groove.

The lock catch is bonded with the inner wall of the drawer cabinet, and the base is bonded with the inner end surface of the drawer.

Two slots are symmetrically arranged on both sides of the connecting block.

The end of the lock catch close to the opening of the drawer cabinet is an inclined plane, and the end of the lock catch close to the opening of the drawer cabinet is thicker.

An installer which is applied to a sliding type children's drawer lock comprises a positioner and an installation scale, the end of the installation scale is inserted into the end of the positioner close to the opening of the drawer cabinet, and a plurality of positioning slots are arranged on the side of the positioner close to the inner wall of the drawer cabinet, and the lock catch is inserted into one of the positioning slots.

The spacing between the positioning slots has a conversion relationship with the reading of the installation scale, and the position of the positioning slot to be inserted by the lock catch is determined by the reading of the installation scale.

Compared with the prior art, the invention has the following advantages:

The invention adopts a pick unlocking device. After the lock hook and the lock catch cooperate to lock, the maximum length that the drawer opens is just enough to expose one end of the pick away from the slots. The pick slides to drive the connecting block to unlock. The lock body is unlocked by opening the drawer for a short distance without exposing the drawer gap. Moreover, the overall volume is small, which unlocks more concealed and not attract the attention of children, so that children can not extend their fingers into the drawer gap, which greatly improves the safety, effectiveness and appearance. The installation doesn't damage the original furniture. The invention makes babies difficult to open but adults convenient to use.

MARKS IN FIGURES

Figure 1:
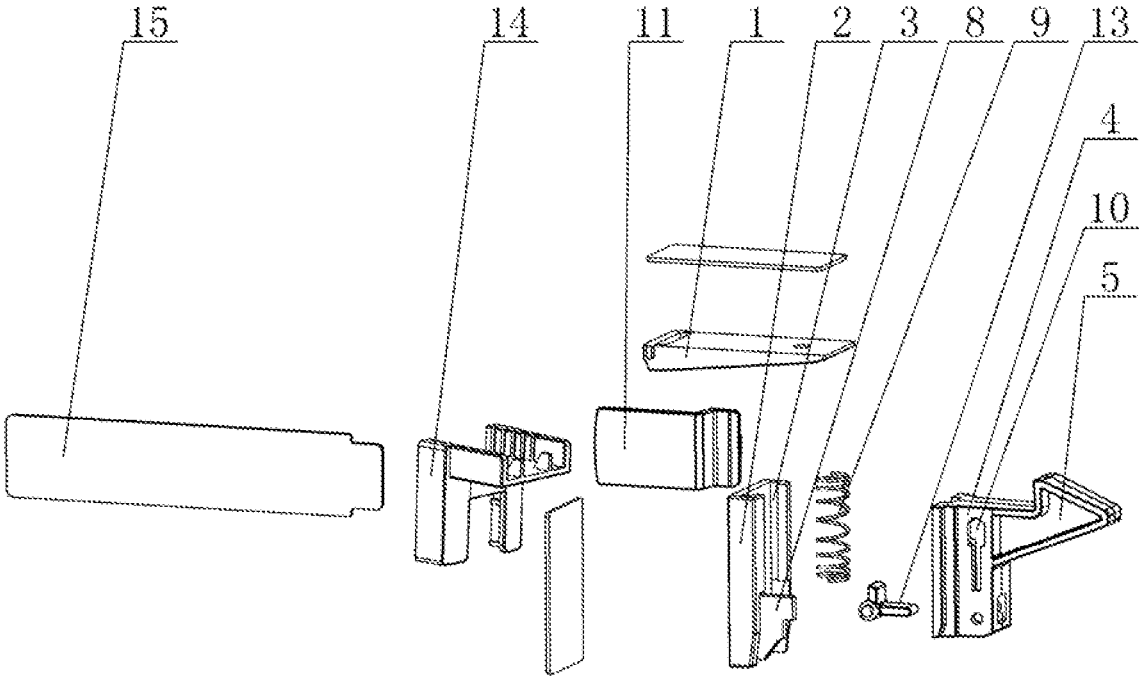
FIG. 1 is an exploded view of the structure of the invention.
Figure 2:
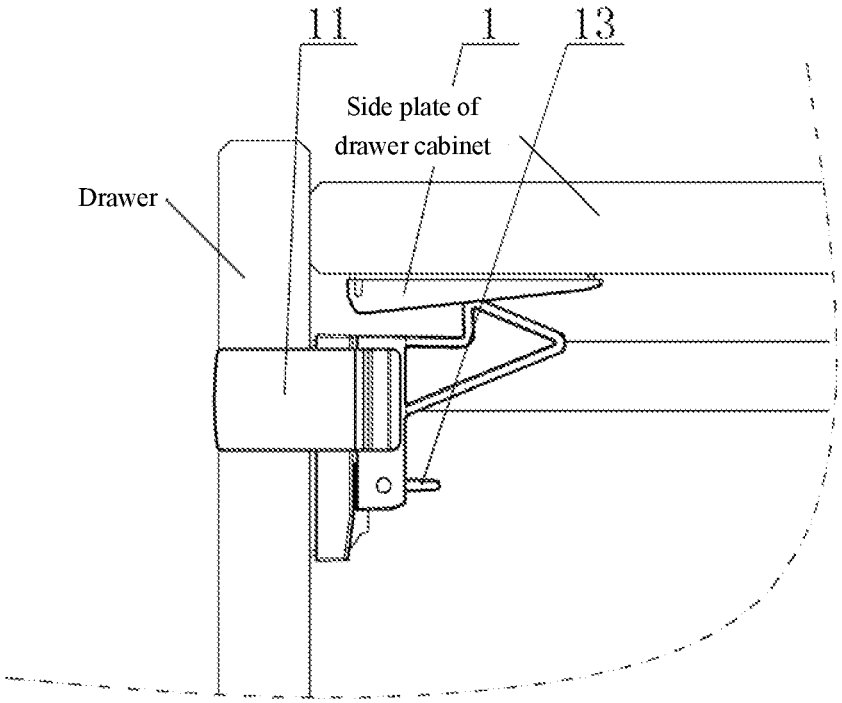
FIG. 2 is a top view of the locked state of the invention.
Figure 3:
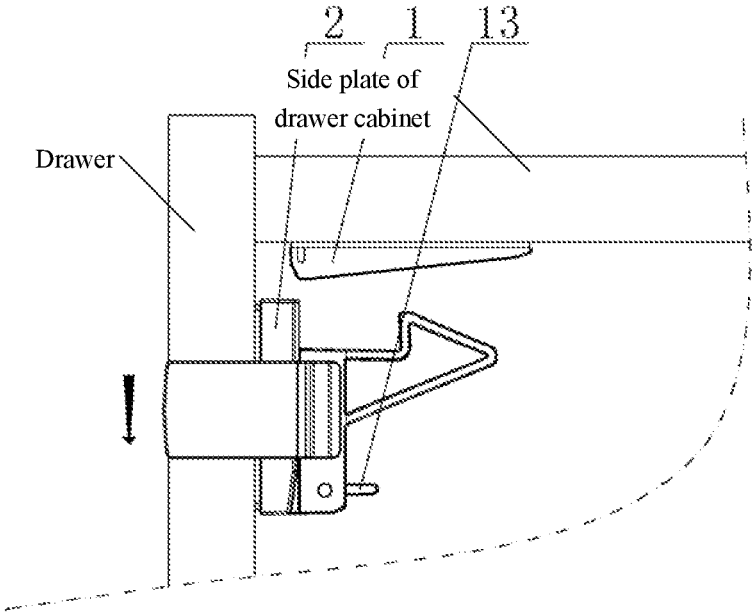
FIG. 3 is a top view of the unlocked state of the invention.
Figure 4:
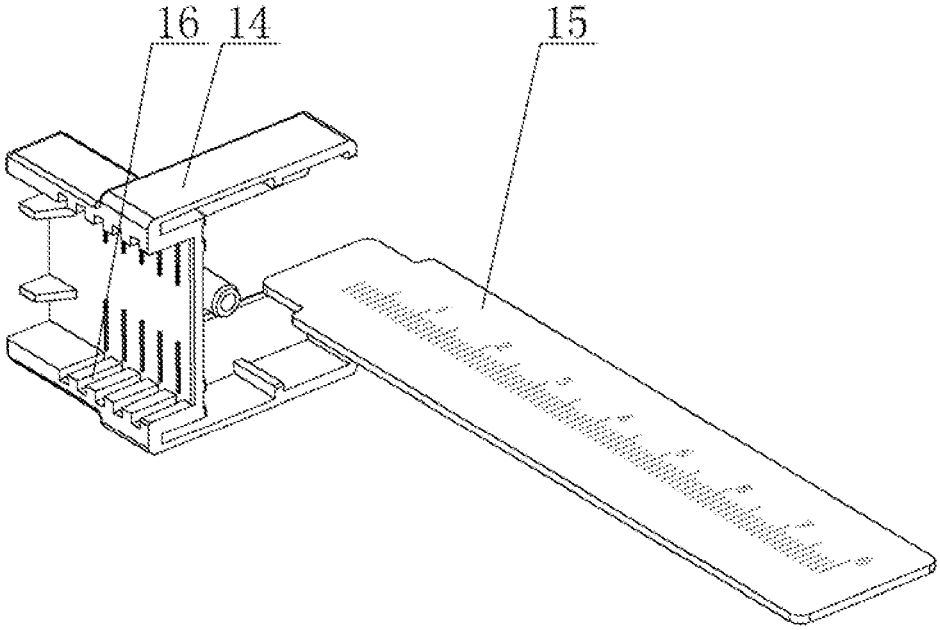
FIG. 4 is a structural diagram of the installation of the invention.
Figure 5:
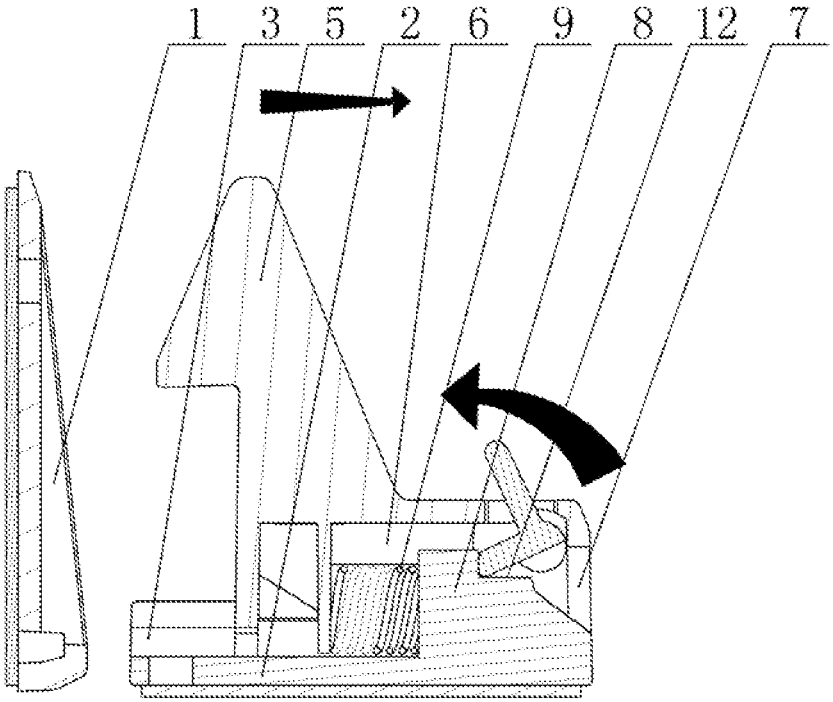
FIG. 5 is a sectional view of the normally open structure of the invention.

1. Lock catch; 2. Base; 3. Chute; 4. Connecting block; 5. Lock hook; 6. Chamber; 7. Jack; 8. Inserting plate; 9. Spring; 10. Slots; 11. Pick; 12. Clamping groove; 13. Lock valve; 14. Positioner; 15. Installation scale; 16. Positioning slot.

DETAILED DESCRIPTION OF PREFERRED EMBODIMENTS

The invention is further described below in combination with specific embodiments. It should be understood that these embodiments are only used to illustrate the invention and not to limit the scope of the invention. In addition, it should be understood that after reading the teaching content of the invention, those skilled in the art can make various changes or modifications to the invention, and these equivalent forms also fall within the scope defined in the application.

The invention relates to a sliding type children's drawer lock, of which the main structure comprises a lock catch 1 arranged on the inner side of the drawer cabinet and located at the opening of the drawer cabinet, a lock body arranged on the inner end surface of the opening and closing end of the drawer and locked with the lock catch 1. The lock body comprises a base 2 arranged on the inner end surface of the opening and closing end of the drawer. The side of the base 2 away from the installation position of the inner end surface of the drawer is provided with a chute 3 with a T-shaped cross section. A connecting block 4 is slidably arranged in the chute 3, and the bottom of the connecting block 4 is also in a T shape. The end of the connecting block 4 away from the base 2 is provided with a lock hook 5 locked with the lock catch 1. The end of the lock catch 1 close to the opening of the drawer cabinet is provided with a baffle, and the lock hook 5 is overlapped and locked with the inner side surface of the baffle. The connecting block 4 is provided with a chamber 6, and the end of the connecting block 4 away from the lock catch 1 is provided with a jack 7 connected with the chamber 6. Both the chamber 6 and the jack 7 pass through the side of the connecting block 4 close to the base 2. The base 2 is provided with an inserting plate 8, which is located in the chamber 6 and inserted into the jack 7. When the connecting block 4 slides on the base 2, the inserting plate 8 passes in and out from the jack 7 for auxiliary guidance. The chamber 6 is provided with a spring 9. One end of the spring 9 is against the inner wall of the chamber 6, and the other end of the spring 9 is against the end surface of the inserting plate 8. After the connecting block 4 drives the lock hook 5 to slide away from the lock catch 1 to unlock, the connecting block 4 is reset under the action of the spring 9. When closing the drawer and after the lock hook 5 contacts with the lock catch 1, the lock catch 1 squeezes the lock hook 5 so that the connecting block 4 slides and squeezes the spring 9 until the lock hook 5 completely passes through the baffle at the end of the lock catch 1, and the spring 9 pushes the lock hook 5 back to realize the automatic locking after the drawer is closed. Slots 10 are opened on the side of the connecting block 4 close to the opening at the top of the drawer, and a pick 11 is inserted in the slots 10 to drive the connecting block 4 to slide in the chute 3. After the installation of the whole lock body, the pick 11 is connected with the lock body. When unlocking, the drawer is directly pulled outward, and the pick 11 drives the connecting block 4 to slide to unlock, and saving key management and insertion, effectively reducing the distance of pulling the drawer, so as to reduce the gap for opening the drawer.

The lock catch 1 and the lock body installed at the specified positions ensure that after the lock hook 5 and the lock catch 1 are locked, the maximum length that the drawer opens is just enough to expose one end of the pick 11 away from the slots 10, so that the drawer is unlocked through the pick 11 only by opening a short distance, and the lock body is unlocked without exposing the drawer gap, making the unlocking of the lock more concealed, which the baby will not find, and the baby can't put fingers into the drawer gap, greatly improving the safety and effectiveness of use, and the concealed design is more beautiful.

Preferably, the side of the inserting plate 8 away from the base 2 and away from the lock catch 1 is provided with a clamping groove 12, the end of the connecting block 4 away from the lock hook 5 and away from the base 2 is rotatably provided with an L-shaped lock valve 13, one end of the lock valve 13 passes through the outer wall of the connecting block 4, and the other end of the lock valve 13 is located in the connecting block 4 and is clamped with the clamping groove 12. The part of the lock valve 13 outside the connecting block 4 is perpendicular to the inner end surface of the drawer. The part of the lock valve 13 inside the connecting block 4 is parallel to the inner end surface of the drawer. The side of the inserting plate 8 away from the base 2 passes through the side of the lock valve 13 to ensure the normal locking and unlocking function of the drawer. To keep the unblocked state, manually slide the connecting block 4 to the unlocked state to make the clamping groove 12 correspond to the position of the lock valve 13, then turn the lock valve 13 so that the end of the lock valve 13 in the connecting block 4 butts against the inner wall of the clamping groove 12 to realize the clamping between the lock valve 13 and the clamping groove 12, and finally fix the lock hook 5 in the unlocked state, which is convenient for the use of the drawer. The use modes are diversified and the use is more flexible and convenient.

Both the lock catch 1 and the base 2 can be fixed and installed with screws, and the lock catch 1 and the base 2 are provided with mounting holes for screw installation. However, in order not to damage the cabinet and drawer, preferably, the lock catch 1 is bonded with the inner wall of the drawer cabinet through adhesive, and the base 2 is bonded with the inner end surface of the drawer through adhesive, so as to realize the traceless installation of the product without furniture damage. In addition, screws can also be used to assist in installation and fixation.

Preferably, two slots 10 are symmetrically arranged on both sides of the connecting block 4, and both the two claw plates of a clamping claw on one side of the installer 14 can be inserted with the mounting scale 15, which can easily install the lock catch 1 and the lock body to the left or right side of the drawer as required for normal use, thus, the user can freely choose the installation direction and use more flexibly.

Preferably, the end of the lock catch 1 close to the opening of the drawer cabinet is an inclined plane. When the drawer is closed, the inclined plane of the lock catch 1 pushes the lock hook 5 away from the lock catch 1. After the drawer is completely closed, the lock hook 5 is pushed back by the spring 9 to automatically lock the drawer, and the end of the lock catch 1 close to the opening of the drawer cabinet is thicker, which is convenient for the overlapping and locking of the lock hook 5 and the lock catch 1.

An installer applied to the sliding type children's drawer lock comprises a positioner 14 and an installation scale 15. One side of the installer 14 is a slot plate and the other side is a clamping claw. The end of the installation scale 15 is inserted with the end of the clamping claw of the positioner 14 close to the opening of the drawer cabinet. A plurality of positioning slots 16 are arranged in the slot on the side of the slot plate of the positioner 14 close to the inner wall of the drawer cabinet. The end of the lock catch 1 is inserted in the positioning slots 16, and the lock catch 1 can be inserted with any positioning slot 16, so as to adjust the installation position of the lock catch 1.

The side of the installer 14 away from the positioning slots 16 is provided with a positioning inserting rod, and the base 2 is provided with a positioning socket inserted with the positioning inserting rod. The spacing between the positioning slots 16 has a conversion relationship with the reading of the installation scale 15. The side of the installer 14 provided with the positioning slots 16 is close to the inner side of the drawer cabinet. After inserting the installation scale 15 into the installer 14, hold the installation scale 15 and close the drawer, and pull the installer 14 to the position in contact with the inner end surface of the drawer through the installation scale 15, determine the position of the positioning slot 16 to be inserted by the lock catch 1 through the reading of the installation scale 15 at this time, then install and fix the lock catch 1, and then slide the connecting block 4 to the unlocked position to insert the positioning inserting rod into the positioning socket, both sides of the base 2 are clamped in the clamping claws on one side of the installer 14, so that the end of the base 2 away from the inserting plate 8 is inserted with the installer 14, and the installer 14 drives the lock body close to the lock catch 1. The height position of the base 2 is determined through the lock catch 1, and the installer 14 determines the spacing between the lock catch 1 and the base 2, so as to ensure that the lock hook 5 overlaps and locks with the lock catch 1, making the installation of the product convenient without any complex tool and convenient to use.

The product is widely used and meets the use needs of almost all daily furniture cabinet doors and drawers.

Working Principle:

1. When closed, the drawer is locked when the lock hook 5 and lock catch 1 of the lock body coincide;
2. Slide the pick 11 to release the lock hook 5 from the lock catch 1 to unlock;
3. Push the lock hook 5 to the end away from the lock catch 1 and turn the lock valve 13 to put the lock body in the normally open state.

Figure 6:
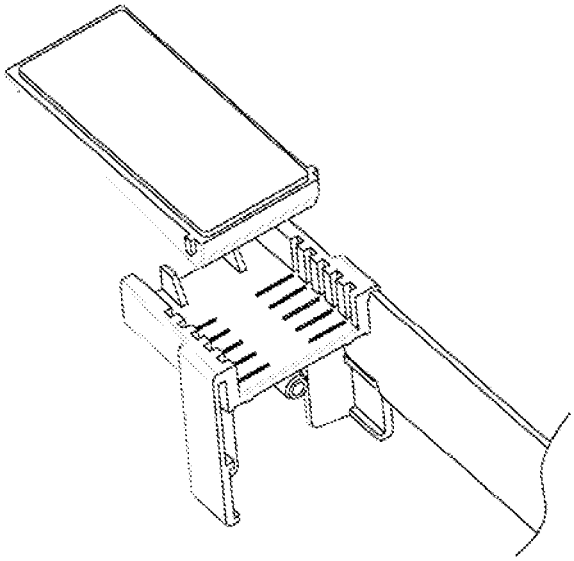
FIG. 6 is an assembly diagram of the installation and lock catch of the invention.
Figure 7:
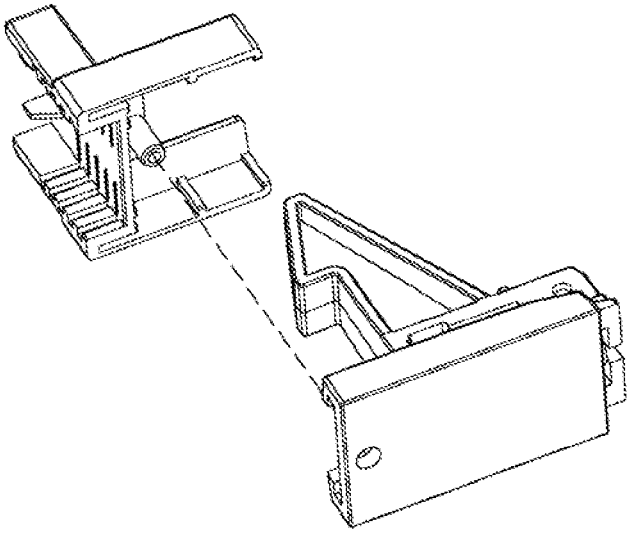
FIG. 7 is an assembly diagram of the installer and lock body of the invention.
Figure 8:
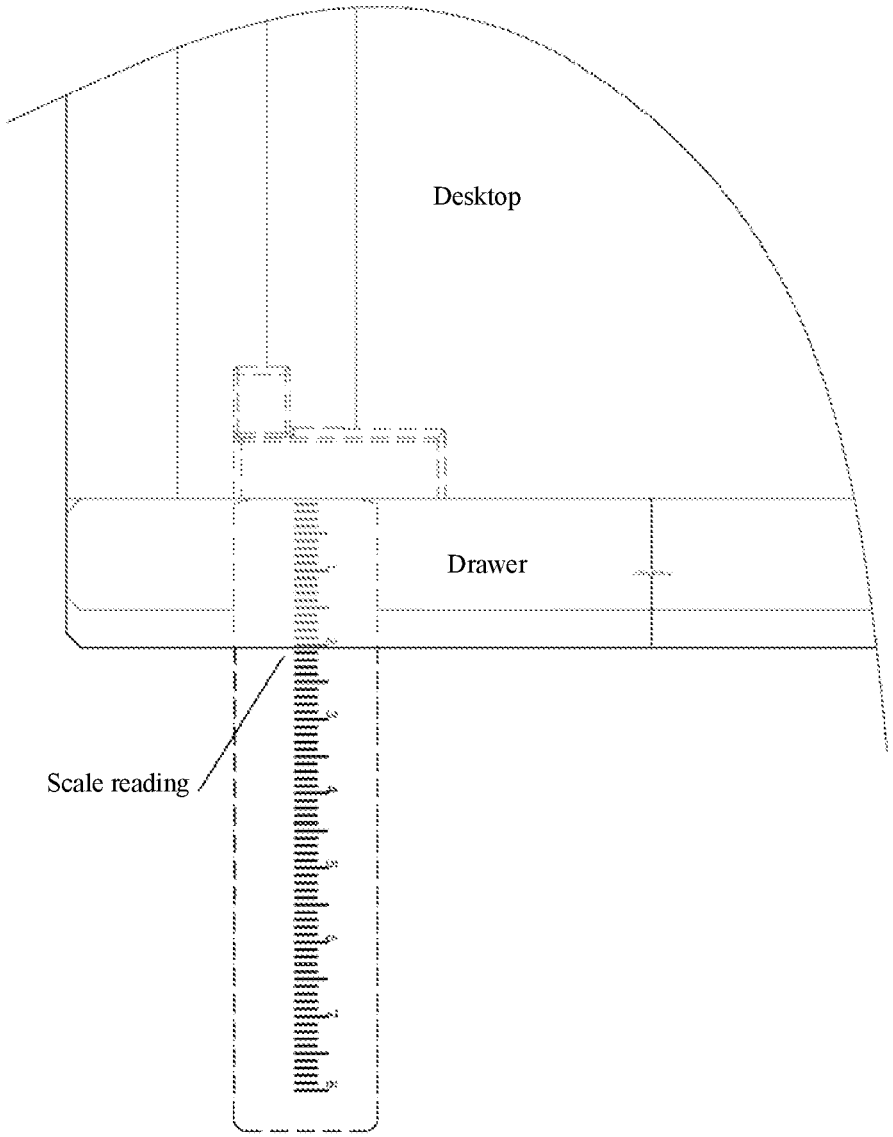
FIG. 8 is a diagram of the measurement and installation method of the invention.
Figure 9:
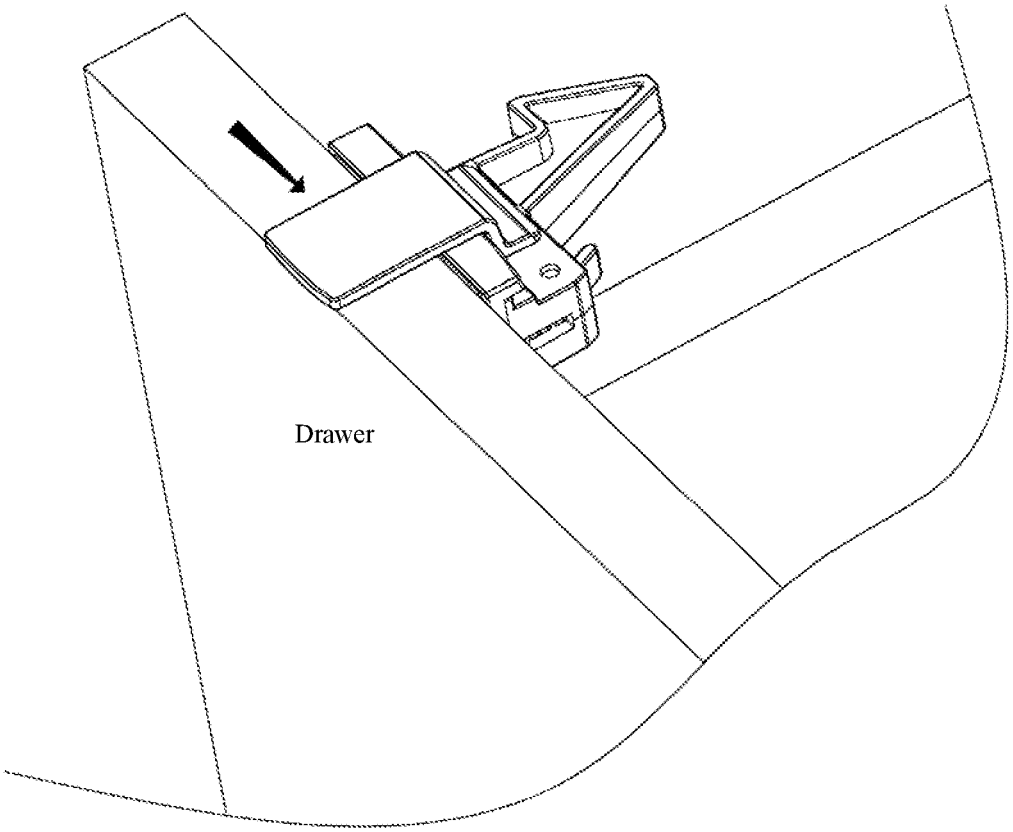
FIG. 9 is a diagram of the installation structure of the lock body and drawer of the invention.

Installation Method: As Shown in FIGS. 6 to 8.

1. Determine the pre-installation position of the drawer, confirm that the gap between the top of the drawer and the bottom of the desktop is greater than 2 mm, or ensure that the pick passes through the gap smoothly;
2. Insert the scale surface of the installation scale upward into the installer. The positioning groove faces left when installing on the left, and faces right when installing on the right;
3. Insert the installation scale into the installer and then put it into the drawer. Close the drawer and gently pull the installation ruler to read. The reading of the installation dimension is about 2.1;
4. If the previous reading of the installation scale is 2.1, select 2.2 according to the upward rounding principle, and insert the latch into the positioning slot corresponding to 2.2 according to the conversion relationship;
5. Peel off the adhesive release paper from the latch, put the above installation components into the drawer, paste the installation ruler flat with the surface of the drawer, smoothly slide the installation scale along the surface of the drawer to the side of the drawer cabinet, paste the latch with the side plate of the drawer cabinet, and then open the drawer;
6. Slide the lock hook to the unlocking position, move the limiter of the lock valve, put the lock body into the installer, insert the positioning inserting rod into the positioning jack, peel off the adhesive release paper of the base, push the drawer into the cabinet, use the installation scale to outward pull the installer to bond the lock body with the inner side of the drawer, and pull out the installation scale to bond the lock body with the inner side of the drawer firmly;
7. Open the drawer again, remove the installer, insert the pick into the slot to complete the installation, and ensure that the maximum distance of the drawer outward pulled is just enough to expose the end of the pick.

The concealed design of the product is simple and beautiful, without affecting the appearance of the original furniture, and the installation and use are more concealed, making babies not find the operation and open the drawer or not injure hands, and greatly improving the safety. The use is very convenient. It only needs to pull out the drawer or cabinet for a short distance to unlock without any key. The operation is faster and more convenient. The wide and flexible range of applications meets the use needs of almost all daily furniture cabinet doors and drawers. The installation is simply completed by high performance self-adhesive without damaging the furniture.

What is claimed is:

1. A sliding type children's drawer lock comprising:

a lock catch (1) arranged on an inner side of a drawer cabinet and located at an opening of the drawer cabinet;

a lock body arranged on an inner end surface of the drawer for cooperatively locking with the lock catch (1);

the lock body comprising:

a base (2) arranged on the inner end surface of the drawer;

a chute (3) opened on a side of the base (2) away from the inner end surface of the drawer, a connecting block slidably arranged in the chute (3);

a lock hook (5) locked and matched with the lock catch (1), which is arranged at the end of a connecting block (4) away from the base (2);

a chamber (6) arranged in the connecting block (4);

a jack (7) communicating with a chamber (6), which is arranged at the end of the connecting block (4) away from the lock catch (1);

an inserting plate (8) arranged on the base (2), the inserting plate (8) is located in the chamber (6) and inserted into the jack (7);

a spring (9) arranged in the chamber (6), one end of the spring (9) is against an inner wall of the chamber (6) and other end of the spring (9) is against an end surface of the inserting plate (8);

slots (10) provided with a side of the connecting block (4) close to the top opening of the drawer, a pick (11) inserted in the slots (10), and the pick (11) drives the connecting block (4) to slide in the chute (3);

installation of the lock catch (1) and the lock body on a designated position ensures that after the lock hook (5) and the lock catch (1) cooperate to lock, the maximum length that the drawer opens is just enough to expose one end of the pick (11) away from the slots (10).

2. The sliding type children's drawer lock according to claim 1, characterized in that an end of the inserting plate (8) away from the base (2) and away from the lock catch (1) is provided with a clamping groove (12), the end of the connecting block (4) away from the lock hook (5) and away from the base (2) is rotatably provided with an L-shaped locking valve (13), one end of the lock valve (13) penetrates an outer wall of the connecting block (4), and other end of the lock valve (13) is located in the connecting block (4) and is clamped with the clamping groove (12).

3. The installer for the sliding type children's drawer lock according to claim 2, comprising a positioner (14) and an installation scale (15), an end of the installation scale (15) is inserted into an end of the positioner (14) close to the opening of the drawer cabinet, and a plurality of positioning slots (16) are arranged on a side of the positioner (14) close to the inner wall of the drawer cabinet, and the lock catch (1) is inserted into one of the positioning slots (16).

4. The installer according to claim 3, characterized in that the spacing between the positioning slots (16) has a conversion relationship with a reading of the installation scale (15), and a position of the positioning slot (16) to be inserted by the lock catch (1) is determined by the reading of the installation scale (15).

5. The sliding type children's drawer lock according to claim 1, characterized in that the lock catch (1) is bonded with the inner wall of the drawer cabinet, and the base (2) is bonded with the inner end surface of the drawer.

6. The installer for the sliding type children's drawer lock according to claim 5, comprising a positioner (14) and an installation scale (15), an end of the installation scale (15) is inserted into an end of the positioner (14) close to the opening of the drawer cabinet, and a plurality of positioning slots (16) are arranged on a side of the positioner (14) close to the inner wall of the drawer cabinet, and the lock catch (1) is inserted into one of the positioning slots (16).

7. The installer according to claim 6, characterized in that the spacing between the positioning slots (16) has a conversion relationship with a reading of the installation scale (15), and a position of the positioning slot (16) to be inserted by the lock catch (1) is determined by the reading of the installation scale (15).

8. The sliding type children's drawer lock according to claim 1, characterized in that two slots (10) are symmetrically arranged on both sides of the connecting block (4).

9. The installer which is applied to a sliding type children's drawer lock according to claim 8, comprising a positioner (14) and an installation scale (15), an end of the installation scale (15) is inserted into an end of the positioner (14) close to the opening of the drawer cabinet, and a plurality of positioning slots (16) are arranged on a side of the positioner (14) close to the inner wall of the drawer cabinet, and the lock catch (1) is inserted into one of the positioning slots (16).

10. The installer according to claim 9, characterized in that the spacing between the positioning slots (16) has a conversion relationship with a reading of the installation scale (15), and a position of the positioning slot (16) to be inserted by the lock catch (1) is determined by the reading of the installation scale (15).

11. The sliding type children's drawer lock according to claim 1, characterized in that an end of the lock catch (1) close to the opening of the drawer cabinet is an inclined plane, and an end of the lock catch (1) close to the opening of the drawer cabinet is thicker.

12. The installer which is applied to a sliding type children's drawer lock according to claim 11, comprising a positioner (14) and an installation scale (15), an end of the installation scale (15) is inserted into an end of the positioner (14) close to the opening of the drawer cabinet, and a plurality of positioning slots (16) are arranged on a side of the positioner (14) close to the inner wall of the drawer cabinet, and the lock catch (1) is inserted into one of the positioning slots (16).

13. The installer according to claim 12, characterized in that the spacing between the positioning slots (16) has a conversion relationship with a reading of the installation scale (15), and the position of the positioning slot (16) to be inserted by the lock catch (1) is determined by the reading of the installation scale (15).

14. The installer used for the sliding type children's drawer lock according to claim 1 comprising a positioner (14) and an installation scale (15), an end of the installation scale (15) is inserted into an end of the positioner (14) close to the opening of the drawer cabinet, and a plurality of positioning slots (16) are arranged on a side of the positioner (14) close to the inner wall of the drawer cabinet, and the lock catch (1) is inserted into one of the positioning slots (16).

15. The installer according to claim 6, characterized in that a spacing between the positioning slots (16) has a conversion relationship with a reading of the installation scale (15), and a position of the positioning slot (16) to be inserted by the lock catch (1) is determined by the reading of the installation scale (15).

* * * * *